US005714114A

United States Patent [19]

Uehara

[11] Patent Number: 5,714,114

[45] Date of Patent: Feb. 3, 1998

[54] HIGH HARDNESS MARTENSITIC STAINLESS STEEL WITH GOOD PITTING CORROSION RESISTANCE

[75] Inventor: Toshihiro Uehara, Yasugi, Japan

[73] Assignee: Hitachi Metals, Ltd., Tokyo, Japan

[21] Appl. No.: 696,829

[22] PCT Filed: Jan. 10, 1996

[86] PCT No.: PCT/JP96/00017

§ 371 Date: Aug. 21, 1996

§ 102(e) Date: Aug. 21, 1996

[87] PCT Pub. No.: WO96/21747

PCT Pub. Date: Jul. 18, 1996

[30] Foreign Application Priority Data

Jan. 13, 1995 [JP] Japan ..... 7-003909

[51] Int. Cl.[6] ..... C22C 38/20; C22C 38/22

[52] U.S. Cl. ..... 420/61; 148/325

[58] Field of Search ..... 148/325; 420/61

[56] References Cited

U.S. PATENT DOCUMENTS

| | | | |
|---|---|---|---|
| 4,450,006 | 5/1984 | Uyehara et al. | 75/125 |

FOREIGN PATENT DOCUMENTS

| | | | |
|---|---|---|---|
| 0 178 334 | 4/1986 | European Pat. Off. | C22C 38/18 |
| 0 472 305 A1 | 2/1992 | European Pat. Off. | C22C 38/44 |
| 57-70265 | 4/1982 | Japan | C22C 38/40 |
| 4-56749 | 2/1992 | Japan | C22C 38/00 |
| 5-163556 | 6/1993 | Japan | C22C 38/00 |
| 6-264194 | 9/1994 | Japan | C22C 38/00 |

*Primary Examiner*—Deborah Yee

*Attorney, Agent, or Firm*—Sughrue, Mion, Zinn, Macpeak & Seas, PLLC

[57] ABSTRACT

An inexpensive martensitic stainless steel which has good hot workability, can be subjected to cold forming with no need of complicated annealing treatment, and exhibits both good pitting corrosion resistance and high hardness after quenching and tempering. The high hardness martensitic stainless steel consists essentially, by weight, of more than 0.15% but not more than 0.40% C, not more than 2.0% Si, not more than 2.0% Mn, not less than 11.0 % but less than 15.0% Cr, 1.0 to 3.0% Mo or Mo and W in terms of Mo+½W, 0.02 to 0.15% N, 0.1 to 1.5% Ni, 0.1 to 2.0% Cu, and the balance iron, Ni and Cu being contained in ranges meeting a relationship of Ni/Cu>0.2, the Cr equivalent being not more than 10, a value of the pitting corrosion resistance index being not less than 20.

10 Claims, No Drawings

HIGH HARDNESS MARTENSITIC STAINLESS STEEL WITH GOOD PITTING CORROSION RESISTANCE

BACKGROUND ART

The present invention relates to a high hardness martensitic stainless steel with good pitting corrosion resistance suitable for use as materials of products which require both good corrosion resistance, particularly pitting corrosion resistance, and high hardness, such as nails, bolts, screws edged tools, springs and so on which are used in the open air and may be possibly exposed to tap water, rainwater, condensed dew or the like, including molds for plastic molding, parts of plastic injection molding machines, etc.

Heretofore, carbon steel containing a relatively large content of carbon or low-alloy steel have seen widespread use as materials of nails, bolts, screws edged tools, springs and so on which require high hardness. But because the content of alloy elements which contribute to corrosion resistance, such as Cr, are small in those types of steel, the steel tends to easily corrode even when exposed to tap water, rainwater, condensed dew or the like that are relatively less corrosive. The problems of marring an appearance and deteriorating the strength have been thus encountered.

On the other hand, stainless steel is employed for applications in which corrosion resistance is required. Austenitic stainless steel represented by SUS304 or SUS316, for example, has good corrosion resistance, but shows large work hardening and poor cold workability and also exhibits hardness of about 43 HRC at maximum even when subjected to considerably heavy cold working. Therefore, austenitic stainless steel is not suitable for applications in which high hardness is required. Further, ferritic stainless steel represented by SUS430, for example, has small work hardening and is relatively easy to perform cold working, but exhibits very low hardness. Accordingly, ferritic stainless steel is also not suitable for applications in which high hardness is required.

Meanwhile, martensitic stainless steel is known as stainless steel having high hardness. However, even SUS410 which is a typical material having achieved extensive use in the fields of automobiles and other industries is not satisfactory in points of corrosion resistance and hardness because the corrosion resistance does not meet a sufficient level and the hardness is about 42 HRC at most. There is SUS440C as martensitic stainless steel having very high hardness. This steel has a C content as high as about 1% and hence shows high hardness not less than 58 HRC, but its corrosion resistance is not satisfactory as stainless steel. Further, stainless steel is relatively highly resistant against corrosion in general, but may locally corrode in the form of small pits, i.e., cause so-called pitting corrosion, in spite of less corrosion as a whole. This has raised the problem that the steel is apt to cause fracture in high hardness materials starting from the corroded pits.

In addition, Japanese Patent Laid-Open No. 57-70265 proposes a high hardness martensitic stainless steel, and Japanese Patent Laid-Open No. 6-264194 proposes a martensitic stainless steel with good corrosion resistance and a drilling tapping screw.

The martensitic stainless steel disclosed in Japanese Patent Laid-Open No. 57-70265 contains 1.0 to 3.0% Cu and not more than 0.2% Ni with 0.5 to 3.0% Mo added, if necessary. However, this steel has had the problem of not surely meeting a satisfactory degree of hot workability because the Cu content is large although the amount of Ni added is small. Depending on combinations of the composition, delta ferrite is apt to be formed and, in this case, there is caused the problem of deteriorating pitting corrosion resistance.

Further, the martensitic stainless steel proposed in Japanese Patent Laid-Open No. 6-264194 does not contain Cu, but a relatively large content of Ni and Mo. But this steel has the problem that hardness after annealing is not sufficiently lowered in a case of a single time of annealing treatment because of the high content of Ni. Therefore, the annealing treatment is required to be repeated several times, which makes the process more complicated. Moreover, the hardness even after several repeated steps of annealing treatment is not always as low as satisfiable, which makes it difficult to perform heavy cold forming.

In view of the above, there has been recently a demand for a martensitic stainless steel which can be readily subjected to hot working and cold forming, and exhibits both good pitting corrosion resistance and high hardness after quenching and tempering.

DISCLOSURE OF THE INVENTION

An object of the present invention is to provide an inexpensive martensitic stainless steel which has good hot workability, can be subjected to cold forming with no need of complicated annealing treatment, and exhibits both good pitting corrosion resistance and high hardness after quenching and tempering.

The inventors have made intensive studies on a martensitic stainless steel containing 13% Cr with a view of achieving good hot workability, good cold formability, and both high hardness and good pitting corrosion resistance. As a result, the following facts have been found after quenching and tempering. To increase pitting corrosion resistance, adding Cu in a small amount is very effective while Mo and N are added as essential elements. Addition of Mo causes delta ferrite to easily generate and reduces pitting corrosion resistance and hot workability. It is therefore required to add Ni in a small amount and N in a large amount for suppressing the generation of adverse delta ferrite. Another feature of the present invention is to make alloy elements properly balanced such that a value A, representing the Cr equivalent, defined by Equation (1) below is held low to suppress the generation of delta ferrite, and a value B defined by Equation (2) below is kept high to increase pitting corrosion resistance:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

Of the above alloy elements, addition of Cu is effective in improving not only pitting corrosion resistance but also cold workability. From this point of view, it is desired to contain Cu as much as possible. But if the Cu content is too large, there would arise a problem of deteriorating hot workability.

Still another feature of the present invention is to, in a 13% Cr high hardness martensitic stainless steel containing elements which tend to deteriorate hot workability, such as Mo and N, add both Ni and Cu in respective particular ranges while meeting the relationship of Ni/Cu>0.2 for a content ratio of Ni to Cu, so that satisfactory hot workability can also be achieved in addition to good pitting corrosion resistance and cold workability.

Still another feature of the present invention is to add N in a large amount while maintaining the C content in a relatively low appropriate range in order to achieve high hardness without reducing the pitting corrosion resistance.

Specifically, a first aspect of the present invention resides in a high hardness martensitic stainless steel with good pitting corrosion resistance, the steel consisting essentially, by weight, of more than 0.15% but not more than 0.40% C, not more than 2.0% Si, not more than 2.0% Mn, not less than 11.0% but less than 15.0% Cr, 1.0 to 3.0% Mo or Mo and W in terms of Mo+½ W, 0.02 to 0.15% N, 0.1 to 1.5% Ni, 0.1 to 2.0% Cu, and the balance iron, Ni and Cu being contained in ranges meeting a relationship expressed by Equation (3) below, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

$$Ni/Cu>0.2 \quad (3)$$

As preferable composition, the high hardness martensitic stainless steel with good pitting corrosion resistance according to the first aspect of the present invention consists essentially, by weight, of more than 0.15% but not more than 0.40% C, not more than 2.0% Si, not more than 2.0% Mn, more than 0.2% but not more than 1.0% Ni, not less than 11.0% but less than 15.0% Cr, 1.0 to 3.0% Mo or Mo and W in terms of Mo+½ W, not less than 0.1% but less than 1.0% Cu, 0.02 to 0.15% N, and the balance iron, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

As more preferable composition, the high hardness martensitic stainless steel with good pitting corrosion resistance according to the first aspect of the present invention consists essentially, by weight, of 0.20 to 0.35% C, not more than 2.0% Si, not more than 2.0% Mn, 0.3% to 0.75% Ni, not less than 11.0% but less than 15.0% Cr, 1.0 to 3.0% Mo or Mo and W in terms of Mo+½ W, not less than 0.1% but less than 1.0% Cu, 0.02 to 0.15% N, and the balance iron, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

A second aspect of the present invention resides in a high hardness martensitic stainless steel with good pitting corrosion resistance, the steel consisting essentially, by weight, of more than 0.15% but not more than 0.40% C, not more than 2.0% Si, not more than 2.0% Mn, not less than 11.0% but less than 15.0% Cr, 1.0 to 3.0% Mo or Mo and W in terms of Mo+½ W, 0.02 to 0.15% N, 0.1 to 1.5% Ni, 0.1 to 2% Cu, in total not more than 0.25% at least one selected from the group consisting of V, Ti and Nb, and the balance iron, Ni and Cu being contained in ranges meeting a relationship expressed by Equation (3) below, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

$$Ni/Cu>0.2 \quad (3)$$

As preferable composition, the high hardness martensitic stainless steel with good pitting corrosion resistance according to the second aspect of the present invention consists essentially, by weight, of more than 0.15% but not more than 0.40% C, not more than 2.0% Si, not more than 2.0% Mn, more than 0.2% but not more than 1.0% Ni, not less than 11.0% but less than 15.0% Cr, 1.0 to 3.0% Mo or Mo and W in terms of Mo+½ W, not less than 0.1% but less than 1.0% Cu, 0.02 to 0.15% N, in total not more than 0.25% at least one selected from the group consisting of V, Ti and Nb, and the balance iron, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

As more preferable composition, the high hardness martensitic stainless steel with good pitting corrosion resistance according to the second aspect of the present invention consists essentially, by weight, of 0.20 to 0.35% C, not more than 2.0% Si, not more than 2.0% Mn, 0.3 to 0.75% Ni, not less than 11.0% but less than 15.0% Cr, 1.0 to 3.0% Mo or Mo and W in terms of Mo+½ W, not less than 0.1% but less than 1.0% Cu, 0.02 to 0.15% N, in total not more than 0.25% one or two or more of V, Ti and Nb, and the balance iron, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

In addition to the above composition, the stainless steel according to any of the first and second aspects of the present invention and the preferable ones thereof may further contain in total not more than 0.10% at least one selected from the group consisting of B, Mg, Ca and Al, if necessary, as well as not more than 5% Co for the purpose of increasing the strength after quenching and tempering.

In the stainless steel of the present invention having any one of the above compositions, preferably, hardness after quenching and tempering is not less than 50 HRC, and a pitting electric potential $V_{c'100}$ in degassed 3.5% salt water at 30° C. is not less than 150 mV (rs S.C.E.). These characteristics can be achieved with any of the above-stated novel compositions according to the present invention.

On the other hand, the stainless steel of the present invention is also featured in that hardness can be reduced down to a sufficiently low level by relatively simple annealing of a single time. Generally, when carrying out, in particular, cold forming such as cold drawing, cold rolling, cold forging, thread rolling and cold bending, hardness after annealing is required to be not more than 250 HV. Conventional similar steel has had a difficulty in reducing hardness after annealing down to be not more than 300 HV, preferably not more than 250 HV, unless the annealing step is repeated several times, and has required complicated heat treatment. In the steel of the present invention, hardness after annealing can be reduced down to be not more than 300 HV by performing a single time of annealing at 700° to 890° C. Particularly, when an upper limit of Ni is not more than 1.0%, hardness after annealing can be reduced down to be not more than 250 HV.

THE BEST MODE FOR CARRYING OUT THE INVENTION

The functions of various elements contained in the stainless steel of the present invention will be described below.

C is essential to obtain the martensite structure after quenching of a 13% Cr stainless steel. Also, C combines with carbide-forming elements to form carbides, and a part thereof is in a solid-solution state in martensite matrix to effectively increase hardness. But if C is added in excess of 0.40%, a carbide of Cr would be formed in a too large amount and the Cr content in the matrix would be so reduced as to deteriorate corrosion resistance. On the other hand, if the C content is not more than 0.15%, not only a sufficient degree of hardness would not be obtained, but also pitting corrosion resistance and hot workability would be reduced due to generation of delta ferrite. Therefore, the C content is set to be more than 0.15% but not more than 0.40%. A preferable range of C is 0.20 to 0.35%.

Si and Mn are added in a small amount for deoxidization. Even if Si and Mn are added in excess of 2.0%, the effect of further improving deoxidization would not be found. Therefore, the content of each of these elements is set to be not more than 2.0%. Further, because Si is an element which tends to generate ferrite and Mn is an element which tends to generate the austenite structure, the matrix structure is affected more or less even with a small amount of these elements. For that reason, Si and Mn are each preferably kept not more than 1.0%.

Ni is an element which serves to suppress the generation of delta ferrite to improve pitting corrosion resistance and is particularly effective in preventing a reduction in hot workability from occurring due to addition of Cu described later. Therefore, Ni is required to be added depending on the content of Cu added.

In the 13% Cr high hardness martensitic stainless steel of the present invention containing, in addition to Cu, other elements which tend to deteriorate hot workability, such as Mo and N, it is particularly required to not only restrict a value of Ni/Cu to be more than 0.2, preferably not less than 0.3, but also limit the Ni content from the reason below. If Ni is less than 0.1%, the sufficient effect can not be obtained. But if Ni is added in excess of 1.5%, the martensitic transformation point is lowered, making it hard to produce the perfect martensite structure after quenching, and hardness after annealing is increased, thereby deteriorating cold workability. Therefore, the Ni content is set to be 0.1 to 1.5° %. A preferable range of Ni is more than 0.2% but not less than 1.0%, and a more preferable range of Ni is 0.3 to 0.75%.

Cr is an important element which has an effect of increasing corrosion resistance, particularly, pitting corrosion resistance, by forming a passive surface film. If Cr is less than 11.0%, a sufficient degree of corrosion resistance can not be obtained. But if Cr is added in excess of 15.0%, delta ferrite is generated, thereby deteriorating pitting corrosion resistance and hot workability. Therefore, the Cr content is set to be not less than 11.0% but less than 15.0%. A preferable range of Cr is 13.0 to 14.0%.

Mo is added in the steel of the present invention as an essential element because it is very effective in stabilizing a passive surface film and hence increasing pitting corrosion resistance. As with Mo, W is also effective in increasing pitting corrosion resistance, but a resultant effect is small when W is added alone. It is preferred that when W is added, a part of Mo is replaced by an equivalent amount of W (½ W corresponding to an equivalent amount of Mo). If Mo alone or both Mo and W are less than 1.0% in terms of Mo+½ W, pitting corrosion resistance is deteriorated. But if Mo or Mo and W are added in excess of 3.0%, delta ferrite is generated, thereby deteriorating pitting corrosion resistance on the contrary and hot workability as well. Therefore, the content of Mo or Mo and W is set to be 1.0 to 3.0%. A preferable range is 1.5 to 2.5%.

Cu is an element which is very effective in greatly increasing pitting corrosion resistance when added in a small amount in the steel containing Cr, Mo and N. If Cu is less than 0.1%, a sufficient effect can not be obtained. But if Cu is added in excess of 2.0%, not only hot workability is deteriorated, but also a sufficient degree of hardness can not be obtained after quenching. Therefore, the Cu content is set to be 0.1 to 2.0%. A preferable range of Cu is not less than 0.1% but less than 1.0%, and a more preferable range of Cu is 0.2 to 0.8%.

Incidentally, even if the Cu content is not more than 2.0%, there still exists a range where hot workability is not sufficient. As stated above in connection with the reason of limiting Ni, therefore, it is required to limit Cu such that the relationship between Ni and Cu meets Ni/Cu>0.2, preferably not less than 0.3.

N is an element which is in a solid-solution state in martensite matrix to increase hardness after quenching, and is also very effective in increasing pitting corrosion resistance. Further, since N has an effect of suppressing the generation of delta ferrite, adding N in place of Ni is effective in saving an expensive alloy element such as Ni and producing a steel material inexpensively, while suppressing the generation of delta ferrite. If N is less than 0.02%, a sufficient effect can not be obtained. But if N is added in excess of 0.15%, soundness of a steel ingot is impaired and manufacturability is deteriorated. Therefore, the N content is set to be 0.02 to 0.15%. A preferable range of N is 0.05 to 0.15%.

V, Ti and Nb are elements which are not necessarily added, but are effective in forming primary carbides and making pre-austenite grain size smaller to thereby improve hardness and ductility. Therefore, one or two or more of V, Ti and Nb are added as required. If one or two or more of V, Ti and Nb are added in excess of 0.25% in total, coarse primary carbides are formed and cold workability is deteriorated. Thus, the content of one or two or more of V, Ti and Nb is preferably set to be not more than 0.25% in total.

B, Mg, Ca and Al are elements which are not necessarily added, but are effective in forming oxides and sulfides and reducing S, O segregated in the preaustenite grain boundary, to thereby improve hot workability. Therefore, one or two or more of B, Mg, Ca and Al are added as required. Even if one or two or more of B, Mg, Ca and Al are added in excess of 0.10% in total, a resultant effect can not be further increased, but cleanness would be lowered on the contrary, thereby deteriorating hot and cold workability. Thus, the content of one or two or more of B, Mg, Ca and Al is preferably set to be not more than 0.10% in total.

To achieve good pitting corrosion resistance, the above-mentioned alloy elements are required to not only meet the respective ranges of their contents, but also meet Equations specified for the steel of the present invention. The value A expressed by Equation (1) represents the Cr equivalent in the steel of the present invention, and the magnitude of the value A is an important index affecting whether or not delta ferrite is apt to form. The value A is given by subtracting values calculated by multiplying weight % of C, Mn, Ni, Cu and N, which are elements tending to form austenite, by coefficients which are experimentally determined depending on the effects of those elements, respectively, from values calculated by multiplying weight % of Cr, Si, Mo, W, V, Ti and Nb, which are elements tending to form ferrite, by coefficients which are experimentally determined depending on the effects of those elements, respectively. As a result of experiments, it has been found in the steel of the present invention that if the value A exceeds 10, delta ferrite is formed, pitting corrosion resistance is greatly deteriorated, and further hot workability and hardness after quenching are reduced. Therefore, the value A expressed by Equation (1) is set to be not more than 10.

The value B expressed by Equation (2) is an important index affecting pitting corrosion resistance of the steel of the present invention, and is given by the sum of values calculated by multiplying weight % of Cr, Mo, W, Cu and N, which are elements directly contributing to an improvement in pitting corrosion resistance, by coefficients which are experimentally determined depending on contributions of the effects of those elements, respectively. In the steel of the present invention, if the value B is less than 20, good pitting corrosion resistance can not be obtained. Therefore, the value B expressed by Equation (2) is set to be not less than 20.

In addition to the elements mentioned above, not more than 5% by weight Co may be added to the steel of the present invention.

Co is in a solid-solution state in the matrix to increase hardness after quenching and tempering. However, Co is not required to be added in a large amount because it is an expensive element.

For P and S as impurity elements, no problems occur if these elements are present at a mixed level that is inevitable in the ordinary melting process and, therefore, no particular limitations are imposed upon P and S. From the standpoint of pitting corrosion resistance, the contents of these elements are preferably as low as possible.

Reasons of restricting characteristic values of the steel of the present invention will be described below.

By carrying out quenching and tempering in an appropriate manner, the steel of the present invention can provide higher hardness than a cold working material of SUS304 and a quenched and tempered material of SUS410. Particularly, when steel is used for nails, screws bolts, edged tools, springs and so on, the steel is required to have hardness not less than 50 HRC for causing these products to fully develop their own abilities. The steel of the present invention can have hardness not less than 50 HRC by quenching it at temperature not lower than about 1000° C. and then performing low-temperature tempering not higher than about 300° C. or high-temperature tempering at about 400° to 500° C. Incidentally, in a case where serious attention is taken on delay fracture resistance in screws, nails, bolts, etc., it is also possible to reduce hardness by selecting a proper tempering temperature.

Further, by carrying out quenching and tempering in an appropriate manner, the steel of the present invention can provide good pitting corrosion resistance while maintaining high hardness. A pitting electric potential is one of known indices representing a degree of pitting corrosion resistance. In order that steel shows good pitting corrosion resistance even when used for members, parts, tools and so on which are used in the open air and may be possibly exposed to tap water, rainwater, condensed dew or the like, the steel is required to have a pitting electric potential $V_{c'100}$ not less than 150 mV (rs S.C.E.) in degassed 3.5% salt water at 30° C. The steel of the present invention can have $V_{c'100}$ not less than 150 mV (vs S.C.E.) by quenching it at temperature not lower than about 1000° C. and then performing low-temperature tempering not higher than about 300° C. Here, the term "pitting" means one form of corrosion that small pits are caused like dispersed dots on the steel surface and that is often observed in stainless steel. The occurrence of pitting not only impairs an appearance, but also may lead to fracture starting from the corroded pits.

The pitting electric potential is measured in accordance with the measurement method specified in JIS G0577 as a process for electrochemical corrosion evaluation and test. In other words, the pitting electric potential is determined as a potential $V_{c'100}$ resulted when current density becomes 100 $\mu A/cm^2$.

The above-stated characteristic values can be provided in a suitable combination depending on uses by appropriately selecting the manufacture method for the steel of the present invention, particularly the conditions of heat treatment. By way of example, for nails, screws bolts, edged tools, springs and so on which are subjected to heat treatment after cold forming, it is possible to provide the steel with required low hardness after annealing not more than 250 HV and required high hardness after quenching and tempering not less than 50 HRC, and if there is a fear of pitting corrosion, it is possible for the steel to have a high pitting electric potential not less than 150 mV (vs S.C.E.).

For screws, bolts, edges tools and so on which are formed by machining without cold forming, a combination of high hardness after quenching and tempering and a high pitting electric potential can be achieved by performing low-temperature tempering. Further, when the steel is used for tools such as molds, only high hardness after quenching and tempering is required depending on applications. Also, when the steel is used for tools which may be exposed to high temperature not less than about 300° C., only high hardness after quenching and tempering is required. In those cases, only high hardness after quenching and tempering can be achieved by performing high-temperature tempering at about 400° to 500° C., for example.

EXAMPLES

The present invention will be described below in connection with Examples. Steels having chemical compositions listed in Tables 1 and 2 were melted by vacuum melting and a 10 kg ingot was obtained for each steel. In the Tables, steels Nos. 1 to 38 each have the composition, the value A, the value B, and the Ni/Cu ratio all of which falls within the ranges limited according to the present invention, i.e., represent the inventive steel, whereas steels Nos. 40 to 52 are comparative steels in each of which one or more of the composition, the value A, the value B and the Ni/Cu ratio are out of the ranges limited according to the present invention.

Each ingot was formed into a 30 mm square bar by hot working, which was heated to 860° C. and then subjected to annealing under furnace cooling. Thereafter, the bar was heated to 1050° C., was kept at that temperature for 30 minutes, and then subjected to quenching by oil cooling. Subsequently, tempering was carried out at 180° C. for 1 hour.

Hardness after annealing was measured by a Vickers hardness tester, and hardness after quenching and tempering was measured by a Rockwell hardness tester. For pitting corrosion resistance, the measurement was made in degassed 3.5% salt water at 30° C. in accordance with JIS G0577 and the potential $V_{c'100}$ resulted when current density becomes 100 $\mu A/cm^2$ was determined as a pitting electric potential. Hot workability was evaluated by giving a mark x for the steel which caused cracks in the surface or corners during hot working, and a mark o for the steel which caused no cracks. Results of the evaluation are listed in Table 3.

TABLE 1

| | Chemical Composition (wt. %) | | | | | | | | | | | | | | | | | | A | B | | |
|---|---|---|---|---|---|---|---|---|---|---|---|---|---|---|---|---|---|---|---|---|---|---|
| Steel No. | C | Si | Mn | Ni | Cr | W | Mo | Cu | N | V | Ti | Nb | B | Mg | Ca | Al | Co | Fr | value | value | Ni/Cu | Remarks |
| 1 | 0.24 | 0.51 | 0.53 | 0.49 | 13.61 | — | 2.01 | 0.46 | 0.077 | — | — | — | — | — | — | — | — | Balance | 8.86 | 23.01 | 1.07 | Steel |
| 1 | 0.24 | 0.51 | 0.53 | 0.49 | 13.61 | — | 2.01 | 0.46 | 0.077 | — | — | — | — | — | — | — | — | Balance | 8.86 | 23.01 | 1.07 | of the |
| 2 | 0.24 | 0.43 | 0.42 | 0.51 | 13.66 | — | 1.98 | 0.50 | 0.101 | — | — | — | — | — | — | — | — | " | 7.65 | 23.72 | 1.02 | invention |
| 3 | 0.26 | 0.31 | 0.80 | 0.68 | 13.96 | — | 2.23 | 0.68 | 0.092 | — | — | — | — | — | — | — | — | " | 5.90 | 24.76 | 1.00 | |
| 4 | 0.29 | 0.61 | 0.32 | 0.78 | 13.12 | — | 2.71 | 0.93 | 0.062 | — | — | — | — | — | — | — | — | " | 8.54 | 24.85 | 0.84 | |
| 5 | 0.21 | 0.12 | 0.89 | 0.25 | 13.38 | — | 1.89 | 0.31 | 0.098 | — | — | — | — | — | — | — | — | " | 6.92 | 22.87 | 0.81 | |
| 6 | 0.34 | 0.42 | 0.42 | 0.49 | 13.59 | 0.02 | 1.99 | 0.49 | 0.045 | — | — | — | — | — | — | — | — | " | 5.38 | 22.03 | 1.00 | |
| 7 | 0.33 | 1.25 | 1.59 | 0.88 | 14.79 | — | 1.51 | 0.49 | 0.044 | — | — | — | — | — | — | — | — | " | 6.13 | 21.58 | 1.80 | |
| 8 | 0.19 | 0.43 | 0.42 | 0.52 | 13.76 | — | 1.99 | 0.54 | 0.091 | — | — | — | — | — | — | — | — | " | 9.97 | 23.60 | 0.96 | |
| 9 | 0.17 | 0.62 | 0.97 | 0.56 | 12.13 | — | 2.13 | 0.61 | 0.083 | — | — | — | — | — | — | — | — | " | 9.68 | 22.26 | 0.92 | |
| 10 | 0.27 | 0.47 | 0.45 | 0.62 | 13.58 | 0.52 | 2.04 | 0.69 | 0.092 | — | — | — | — | — | — | — | — | " | 7.28 | 24.62 | 0.90 | |
| 11 | 0.23 | 0.29 | 0.55 | 0.41 | 13.77 | — | 1.88 | 0.92 | 0.075 | — | — | — | — | — | — | — | — | " | 7.00 | 23.14 | 0.45 | |
| 12 | 0.27 | 0.39 | 0.52 | 0.67 | 13.65 | — | 2.11 | 0.32 | 0.081 | — | — | — | — | — | — | — | — | " | 6.84 | 23.36 | 2.09 | |
| 13 | 0.22 | 0.33 | 0.73 | 0.36 | 13.42 | — | 2.02 | 0.37 | 0.090 | — | — | — | — | — | — | — | — | " | 8.34 | 23.16 | 0.97 | |
| 14 | 0.23 | 0.34 | 0.30 | 0.16 | 13.81 | — | 1.89 | 0.57 | 0.077 | — | — | — | — | — | — | — | — | " | 9.52 | 22.93 | 0.28 | |
| 15 | 0.27 | 0.39 | 0.44 | 0.59 | 13.27 | — | 2.13 | 1.64 | 0.078 | — | — | — | — | — | — | — | — | Balance | 4.47 | 24.28 | 0.36 | |
| 16 | 0.28 | 0.42 | 0.42 | 1.14 | 13.46 | — | 2.21 | 1.79 | 0.091 | — | — | — | — | — | — | — | — | " | 1.91 | 25.27 | 0.64 | |
| 17 | 0.25 | 0.45 | 0.54 | 0.75 | 13.58 | — | 1.82 | 1.33 | 0.069 | — | — | — | — | — | — | — | — | " | 4.75 | 22.99 | 0.56 | |
| 18 | 0.24 | 0.32 | 0.67 | 1.27 | 13.22 | — | 1.98 | 0.61 | 0.068 | — | — | — | — | — | — | — | — | " | 3.78 | 22.40 | 2.08 | |
| 19 | 0.26 | 0.39 | 0.49 | 1.32 | 13.78 | — | 2.03 | 1.26 | 0.073 | — | — | — | — | — | — | — | — | " | 2.87 | 23.93 | 1.05 | |
| 20 | 0.28 | 0.39 | 0.58 | 0.55 | 13.54 | — | 2.14 | 0.52 | 0.083 | 0.09 | — | — | — | — | — | — | — | " | 7.43 | 23.61 | 1.06 | |
| 21 | 0.26 | 0.52 | 1.82 | 0.69 | 13.14 | — | 2.37 | 0.44 | 0.079 | — | 0.07 | — | — | — | — | — | — | " | 6.39 | 23.77 | 1.57 | |
| 22 | 0.24 | 0.39 | 0.63 | 0.61 | 13.69 | — | 2.02 | 0.58 | 0.071 | — | — | 0.05 | — | — | — | — | — | " | 7.77 | 23.07 | 1.05 | |
| 23 | 0.27 | 0.54 | 0.42 | 0.67 | 13.66 | — | 1.91 | 0.52 | 0.085 | 0.12 | — | 0.06 | — | — | — | — | — | " | 8.37 | 23.03 | 1.29 | |
| 24 | 0.26 | 0.36 | 0.62 | 0.44 | 13.42 | — | 2.19 | 0.56 | 0.086 | — | 0.03 | 0.05 | — | — | — | — | — | " | 7.79 | 23.79 | 0.79 | |
| 25 | 0.30 | 0.58 | 0.69 | 6.63 | 13.59 | — | 2.14 | 0.77 | 0.093 | 0.03 | 0.02 | — | — | — | — | — | — | " | 5.96 | 4.21 | 0.82 | |
| 26 | 0.38 | 0.33 | 0.71 | 0.31 | 13.49 | 0.04 | 2.16 | 0.63 | 0.103 | 0.07 | 0.02 | 0.04 | — | — | — | — | — | " | 3.22 | 24.40 | 0.49 | |
| 27 | 0.24 | 0.52 | 0.49 | 0.62 | 13.57 | — | 2.33 | 0.54 | 0.095 | — | — | — | 0.0012 | — | — | — | — | " | 9.02 | 24.65 | 1.15 | |
| 28 | 0.26 | 0.63 | 0.57 | 0.54 | 14.21 | 0.86 | 1.42 | 0.55 | 0.093 | — | — | — | — | 0.0025 | — | — | — | " | 7.80 | 23.66 | 0.98 | |
| 29 | 0.25 | 0.15 | 0.12 | 0.53 | 12.99 | — | 2.06 | 0.51 | 0.084 | — | — | — | — | — | 0.0019 | — | — | " | 6.23 | 22.82 | 1.04 | |
| 30 | 0.32 | 0.49 | 0.63 | 0.64 | 13.77 | — | 2.15 | 0.66 | 0.065 | — | — | — | — | — | — | 0.03 | — | " | 5.42 | 23.48 | 0.97 | |

TABLE 2

| Steel No. | Chemical Composition (wt. %) C | Si | Mn | Ni | Cr | W | Mo | Cu | N | V | Ti | Nb | B | Mg | Ca | Al | Co | Fr | A value | B value | Ni/Cu | Remarks |
|---|---|---|---|---|---|---|---|---|---|---|---|---|---|---|---|---|---|---|---|---|---|---|
| 31 | 0.29 | 0.51 | 0.52 | 0.55 | 13.26 | — | 1.98 | 0.59 | 0.087 | — | — | — | 0.0031 | — | — | 0.02 | — | Balance | 5.61 | 22.99 | 0.93 | Steel |
| 32 | 0.22 | 0.43 | 0.69 | 0.91 | 14.03 | — | 2.22 | 0.79 | 0.114 | — | — | — | — | 0.0011 | 0.0013 | 0.01 | — | " | 6.67 | 25.57 | 1.15 | of the |
| 33 | 0.26 | 0.58 | 0.47 | 0.53 | 13.62 | — | 2.08 | 0.53 | 0.099 | — | — | — | 0.0011 | 0.0014 | 0.0007 | 0.02 | — | " | 7.93 | 23.98 | 1.00 | invention |
| 34 | 0.25 | 0.56 | 0.57 | 0.58 | 13.63 | — | 2.11 | 0.60 | 0.089 | — | — | — | — | 0.0012 | — | 0.01 | — | " | 8.10 | 23.83 | 0.97 | |
| 35 | 0.34 | 0.32 | 0.56 | 0.52 | 13.58 | — | 2.31 | 0.56 | 0.071 | — | — | 0.07 | 0.0010 | — | — | 0.02 | — | " | 5.04 | 23.89 | 0.93 | |
| 36 | 0.28 | 0.37 | 0.48 | 0.62 | 12.71 | — | 2.29 | 0.70 | 0.063 | — | — | — | — | — | — | — | 2.13 | " | 6.16 | 22.86 | 0.89 | |
| 37 | 0.27 | 0.55 | 0.41 | 0.56 | 13.88 | — | 2.43 | 0.68 | 0.089 | — | — | — | — | 0.00023 | — | — | 4.01 | " | 9.01 | 25.25 | 0.82 | |
| 38 | 0.25 | 0.41 | 0.56 | 0.58 | 13.50 | — | 2.29 | 0.61 | 0.082 | — | 0.06 | — | — | — | — | — | 1.22 | " | 8.60 | 24.13 | 0.95 | |
| 40 | 0.46 | 0.35 | 0.42 | 0.22 | 13.11 | — | 1.21 | 0.13 | 0.023 | — | — | — | — | — | — | — | — | " | −1.02 | 17.92 | 1.69 | |
| 41 | 0.11 | 0.52 | 0.62 | 0.02 | 13.96 | — | 1.36 | 0.04 | 0.032 | — | — | — | — | — | — | — | — | " | 15.76 | 19345 | 0.50 | |
| 42 | 0.23 | 0.36 | 0.45 | 0.21 | 15.63 | — | 2.11 | 0.23 | 0.042 | — | — | — | — | — | — | — | — | " | 13.57 | 24.08 | 0.91 | Compara- |
| 43 | 0.21 | 0.69 | 0.53 | 0.01 | 10.82 | — | 0.89 | 0.45 | 0.036 | — | — | — | — | — | — | — | — | " | 7.04 | 15.29 | 0.02 | tive |
| 44 | 0.29 | 0.56 | 0.21 | 0.51 | 13.75 | — | 3.39 | 0.49 | 0.063 | — | — | — | — | — | — | — | — | " | 13.74 | 27.32 | 1.04 | Steel |
| 45 | 0.38 | 0.43 | 0.42 | — | 13.61 | — | 1.26 | — | 0.013 | — | — | — | — | — | — | — | — | " | 4.80 | 18.16 | ∞ | |
| 46 | 0.17 | 0.43 | 0.59 | 2.21 | 13.22 | — | 2.03 | — | 0.112 | — | — | — | — | — | — | — | — | " | 3.74 | 23.28 | ∞ | |
| 47 | 0.21 | 0.36 | 0.45 | 0.21 | 13.96 | — | 2.33 | 1.52 | 0.065 | — | — | — | — | — | — | — | — | " | 10.31 | 25.12 | 0.14 | |
| 48 | 0.26 | 2.33 | 0.66 | 0.36 | 13.68 | — | 1.87 | 0.42 | 0.056 | — | — | — | — | — | — | — | — | " | 19.46 | 21.95 | 0.86 | |
| 49 | 0.32 | 0.47 | 0.96 | 0.43 | 12.84 | — | 2.31 | 2.68 | 0.067 | — | — | — | — | — | — | — | — | " | 1.09 | 25.15 | 0.16 | |
| 50 | 0.21 | 0.21 | 0.25 | 0.93 | 13.97 | — | 1.74 | 2.85 | 0.084 | — | — | — | — | — | — | — | — | " | 1.35 | 25.08 | 0.33 | |
| 51 | 0.29 | 0.68 | 0.52 | 1.87 | 13.85 | — | 1.39 | 0.79 | 0.059 | — | — | — | — | — | — | — | — | " | 0.02 | 21.00 | 2.37 | |
| 52 | 0.25 | 0.99 | 0.74 | 1.58 | 13.22 | — | 2.08 | 0.08 | 0.042 | — | — | — | — | — | — | — | — | " | 8.26 | 21.42 | 19.75 | |

TABLE 3

| Alloy No. | Hardness after Quenching and tempering (HRC) | Pitting Electric Potential $V_c'_{100}$ (mV vs S.C.E.) | after annealing (HV) | Hot work-ability | Remarks |
|---|---|---|---|---|---|
| 1 | 55.2 | 237.3 | 223 | ○ | Steel of the invention |
| 2 | 55.0 | 249.6 | 221 | ○ | " |
| 3 | 54.9 | 238.2 | 219 | ○ | " |
| 4 | 54.1 | 235.6 | 232 | ○ | " |
| 5 | 54.8 | 233.4 | 222 | ○ | " |
| 6 | 56.3 | 203.1 | 213 | ○ | " |
| 7 | 55.8 | 198.5 | 215 | ○ | " |
| 8 | 51.9 | 213.6 | 203 | ○ | " |
| 9 | 51.2 | 198.3 | 225 | ○ | " |
| 10 | 55.6 | 249.2 | 222 | ○ | " |
| 11 | 53.8 | 224.7 | 227 | ○ | " |
| 12 | 54.2 | 228.8 | 247 | ○ | " |
| 13 | 54.6 | 225.2 | 211 | ○ | " |
| 14 | 55.0 | 181.4 | 203 | ○ | " |
| 15 | 50.7 | 223.1 | 236 | ○ | " |
| 16 | 50.5 | 233.8 | 278 | ○ | " |
| 17 | 50.9 | 210.2 | 244 | ○ | " |
| 18 | 54.8 | 203.7 | 286 | ○ | " |
| 19 | 55.1 | 225.6 | 292 | ○ | " |
| 20 | 55.4 | 226.8 | 231 | ○ | " |
| 21 | 55.1 | 231.7 | 241 | ○ | " |
| 22 | 54.8 | 218.4 | 242 | ○ | " |
| 23 | 55.0 | 226.9 | 245 | ○ | " |
| 24 | 54.9 | 227.6 | 244 | ○ | " |
| 25 | 55.3 | 241.3 | 239 | ○ | " |
| 26 | 56.1 | 246.8 | 236 | ○ | Steel of the invention |
| 27 | 54.3 | 256.1 | 226 | ○ | " |
| 28 | 54.9 | 226.0 | 232 | ○ | " |
| 29 | 55.1 | 203.3 | 224 | ○ | " |
| 30 | 55.5 | 235.5 | 229 | ○ | " |
| 31 | 55.4 | 263.7 | 228 | ○ | " |
| 32 | 55.1 | 246.3 | 241 | ○ | " |
| 33 | 54.7 | 251.4 | 235 | ○ | " |
| 34 | 54.3 | 239.3 | 227 | ○ | " |
| 35 | 55.2 | 229.4 | 229 | ○ | " |
| 36 | 55.7 | 220.2 | 247 | ○ | " |
| 37 | 55.6 | 244.1 | 232 | ○ | " |
| 38 | 55.2 | 251.8 | 231 | ○ | " |
| 40 | 56.2 | 99.1 | 213 | ○ | Comparative Steel |
| 41 | 42.0 | 136.4 | 204 | ○ | " |
| 42 | 48.1 | 92.5 | 211 | ○ | " |
| 43 | 47.6 | 54.9 | 206 | × | " |
| 44 | 50.3 | 69.8 | 221 | ○ | " |
| 45 | 56.4 | 62.4 | 216 | ○ | " |
| 46 | 50.3 | 232.2 | 434 | ○ | " |
| 47 | 47.8 | 121.3 | 203 | × | " |
| 48 | 50.3 | 36.2 | 201 | ○ | " |
| 49 | 49.8 | 163.4 | 232 | × | " |
| 50 | 49.4 | 188.3 | 282 | ○ | " |
| 51 | 54.6 | 179.8 | 405 | ○ | " |
| 52 | 53.2 | 177.6 | 378 | ○ | " |

As will be seen from Table 3, each of the inventive steels Nos. 1 to 38 has high hardness after quenching and tempering not less than 50 HRC and also has a high pitting electric potential $V_c'_{100}$ not less than 150 mV (vs S.C.E.). This means that the inventive steels each have both good pitting corrosion resistance and high hardness. It will be also seen that, except for the steels Nos. 18 and 19, the inventive steels Nos. 1 to 38 have hardness after annealing not more than 250 HV and hence can be sufficiently formed by cold working. Although the steels Nos. 18 and 19 contain Ni in an amount near an upper limit of the allowable range and have relatively high hardness after annealing, the hardness after annealing is not more than 300 HV and light cold working can be performed. Accordingly, in the case of not requiring cold working with a large cold reduction, the steels Nos. 18 and 19 are also satisfactorily usable as with the other inventive steels because of showing good pitting corrosion resistance and high hardness after quenching and tempering.

Further, each of the inventive steels Nos. 1 to 38 has so good hot workability that desired materials can be satisfactorily manufactured through a hot working process such as hot forging and hot rolling.

On the contrary, for the comparative steels Nos. 40 to 52 in each of which one or more of the composition, the value A, the value B and the Ni/Cu ratio are out of the ranges limited according to the present invention, it will be seen that one or more of characteristics, i.e., hardness after quenching and tempering, pitting corrosion resistance, hardness after annealing, and hot workability, are inferior to the inventive steel.

Particularly, for the comparative steels Nos. 40 to 45, 47 and 48 in which one or both of the values A and B are deviated from the limited ranges, the pitting electric potential has a low value and pitting corrosion resistance is not sufficient. Also, for the comparative steels Nos. 43, 47 and 49 in which the Ni/Cu ratio is low, and for the comparative steels Nos. 49 and 50 in which the Cu content is high, hot workability is poor and hence manufacturability of materials is poor. Further, for the comparative steels Nos. 46, 51 and 52 in which the Ni content is high, hardness after annealing is higher than 300 HV and cold workability is poor, resulting in reduced workability of materials, parts, members and so on.

INDUSTRIAL APPLICABILITY

As described above, the martensitic stainless steel of the present invention has good hot workability, low hardness after annealing, good pitting corrosion resistance and high hardness after quenching and tempering. It is also possible to provide the steel of the present invention with those four characteristics in a suitable combination. Therefore, when the inventive steel is used for parts, members, tools and so on which are used in the open air and may be possibly exposed to tap water, rainwater, condensed dew or the like, reliability and service life can be greatly improved while keeping the cost relatively low. As a result, the present invention provides a remarkable effect from the industrial point of view.

We claim:

1. A high hardness martensitic stainless steel with good pitting corrosion resistance, said steel consisting essentially, by weight, of more than 0.15% but not more than 0.40% C, not more than 2.0% Si, not more than 2.0% Mn, not less than 11.0% but less than 15.0% Cr, 1.0 to 3.0% Mo or Mo and W in terms of Mo+½ W, 0.02 to 0.15% N, 0.1 to 1.5% Ni, 0.1 to 2.0% Cu, and the balance iron, Ni and Cu being contained in ranges meeting a relationship expressed by Equation (3) below, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

$$Ni/Cu>0.2 \quad (3).$$

2. A high hardness martensitic stainless steel with good pitting corrosion resistance, said steel consisting essentially, by weight, of more than 0.15% but not more than 0.40% C, not more than 2.0% Si, not more than 2.0% Mn, more than 0.2% but not more than 1.0% Ni, not less than 11.0% but less than 15.0% Cr, 1.0 to 3.0% Mo or Mo and W in terms of Mo+½ W, not less than 0.1% but less than 1.0% Cu, 0.02 to 0.15% N, and the balance iron, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero).

3. A high hardness martensitic stainless steel with good pitting corrosion resistance, said steel consisting essentially, by weight, of 0.20 to 0.35% C, not more than 2.0% Si, not more than 2.0% Mn, 0.3% to 0.75% Ni, not less than 11.0% but less than 15.0% Cr, 1.0 to 3.0% Mo or Mo and W in terms of Mo+½ W, not less than 0.1% but less than 1.0% Cu, 0.02 to 0.15% N, and the balance iron, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero).

4. A high hardness martensitic stainless steel with good pitting corrosion resistance, said steel consisting essentially, by weight, of more than 0.15% but not more than 0.40% C, not more than 2.0% Si, not more than 2.0% Mn, not less than 11.0% but less than 15.0% Cr, 1.0 to 3.0% Mo or Mo and W in terms of Mo +½ W, 0.02 to 0.15% N, 0.1 to 1.5% Ni, 0.1 to 2% Cu, in total not more than 0.25% at least one selected from the group consisting of V, Ti and Nb, and the balance iron, Ni and Cu being contained in ranges meeting a relationship expressed by Equation (3) below, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero)

$$Ni/Cu>0.2 \quad (3).$$

5. A high hardness martensitic stainless steel with good pitting corrosion resistance, said steel consisting essentially, by weight, of more than 0.15% but not more than 0.40% C, not more than 2.0% Si, not more than 2.0% Mn, more than 0.2% but not more than 1.0% Ni, not less than 11.0% but less than 15.0% Cr, 1.0 to 3.0% Mo or Mo and W in terms of Mo+½ W, not less than 0.1% but less than 1.0% Cu, 0.02 to 0.15% N, in total not more than 0.25% at least one selected from the group consisting of V, Ti and Nb, and the balance iron, a value A defined by Equation (1) below being not more than 10, a value B defined by Equation (2) below being not less than 20:

$$A=-40C+6Si-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero).

6. A high hardness martensitic stainless steel with good pitting corrosion resistance, said steel consisting essentially, by weight, of 0.20 to 0.35% C, not more than 2.0% Si, not more than 2.0% Mn, 0.3 to 0.75% Ni, not less than 11.0% but less than 15.0% Cr, 1o0 to 3.0% Mo or Mo and W in terms of Mo+½ W, not less than 0.1% but less than 1.0% Cu, 0.02 to 0.15% N, in total not more than 0.25% at least one selected from the group consisting of V, Ti and Nb, and the balance iron, a value A defined by Equation (1) below being not more than 10, a value B defined by Equation (2) below being not less than 20:

$$A=-40C+6Ni-2Mn-4Ni+Cr+4Mo+2W-2Cu-30N+11V+10Ti+5Nb \quad (1)$$

(where the value A is calculated by setting those ones of selective elements which are not added to be zero)

$$B=Cr+3.3Mo+1.65W+Cu+30N \quad (2)$$

(where the value B is calculated by setting those ones of selective elements which are not added to be zero).

7. A high hardness martensitic stainless steel with good pitting corrosion resistance wherein, in addition to the steel composition according to any one of claims 1 to 6, said steel contains in total not more than 0.10% at least one selected from the group consisting of B, Mg, Ca and Al.

8. A high hardness martensitic stainless steel with good pitting corrosion resistance according to any one of claims 1 to 7, wherein hardness after quenching and tempering is not less than 50 HRC.

9. A high hardness martensitic stainless steel with good pitting corrosion resistance according to any one of claims 1 to 8, wherein a pitting electric potential $V_c'_{100}$ in degassed 3.5% salt water at 30° C. is not less than 150 mV (vs S.C.E.).

10. A high hardness martensitic stainless steel with good pitting corrosion resistance according to any one of claims 1 to 9, wherein hardness after one step of annealing at 700° to 890° C. is not more than 250 HV.

* * * * *